United States Patent [19]

Lee

[11] 4,212,454

[45] Jul. 15, 1980

[54] OPERATION TABLE

[75] Inventor: Norman J. Lee, London, England

[73] Assignee: Matburn (Holdings) Limited, London, England

[21] Appl. No.: 899,107

[22] Filed: Apr. 24, 1978

[30] Foreign Application Priority Data

Apr. 28, 1977 [GB] United Kingdom ..... 17770/77

[51] Int. Cl.[2] ..... A61G 13/00

[52] U.S. Cl. ..... 269/328

[58] Field of Search ..... 269/322-328; 403/330

[56] References Cited

U.S. PATENT DOCUMENTS 3,450,425 6/1969 Leonhardt ..... 403/330

FOREIGN PATENT DOCUMENTS 814770 6/1959 United Kingdom ..... 269/328

*Primary Examiner*—Robert C. Watson

*Attorney, Agent, or Firm*—McAulay, Fields, Fisher & Goldstein

[57] ABSTRACT

A surgical operation table has a platform with a main section and an end extension section removably fitted adjacent an end of the main section. The extension section has a pair of support arms removably engageable in complementary sockets secured to the main section. At least one of the sockets has a spring locking plate which is engageable with a support arm inserted in the socket to prevent the arm being withdrawn from the socket. Means are provided for disengaging the locking plate from the arm when it is desired to remove the extension section from the main section.

4 Claims, 2 Drawing Figures

OPERATION TABLE

BACKGROUND

Surgical operation tables comprise a patient supporting surface, sometimes called a table top or platform and hereinafter referred to as a platform, a base which may be fixed but which is usually movable, and a support column which supports the platform on the base in such a way that the platform can be raised or lowered with respect to the base.

It is commonplace for such a table to have a platform composed of a main section or sections, usually called a trunk section or sections, and an extension section removably fitted to one, or to each, end of the platform.

An object of the present invention is to provide a surgical operation table with an improved arrangement for securing an extension section to an end of the platform, which enables the extension section to be firmly and automatically locked in position while nevertheless being easily releasable as desired.

SUMMARY OF THE INVENTION

A surgical operation table has a patient supporting platform with a main section and an end extension section which may be removably fitted adjacent an end of the main section, wherein the said extension section has a pair of support arms removably engageable in complementary sockets secured to the main section, at least one socket being provided with a spring locking plate which is engageable with a support arm inserted in the socket to prevent the arm being withdrawn from the socket, and means being provided for disengaging the locking plate from the arm when it is desired to remove the extension section from the platform.

DESCRIPTION OF AN EMBODIMENT

Figure 1:
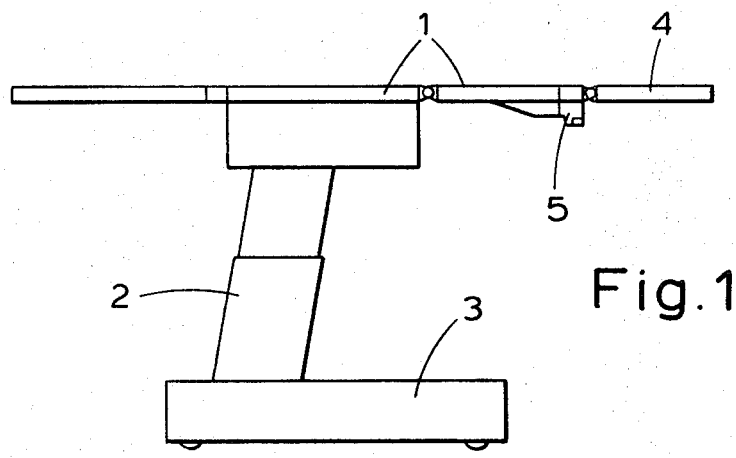
FIG. 1 is a schematic elevation of a surgical operation table.
Figure 2:
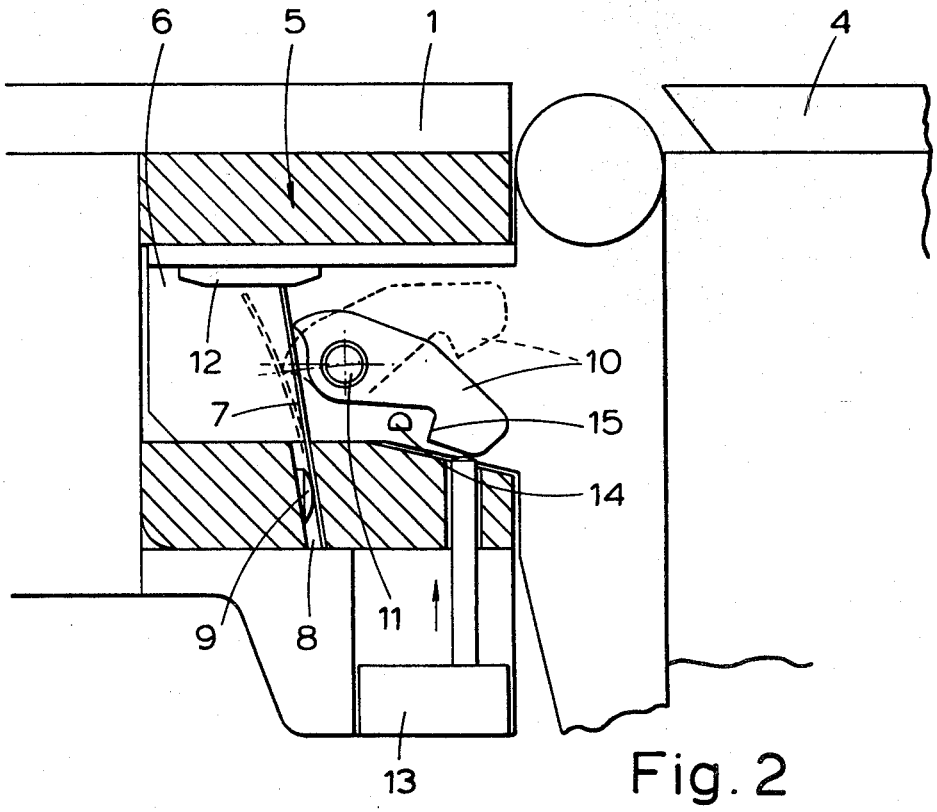
FIG. 2 is a detail view of a locking socket and portion of an extension section of the table.

A surgical operation table has a patient supporting platform or table top composed of main or trunk sections 1 carried in any suitable way by a support column 2 on a base 3. A removable extension section 4 is fitted to one end of the main sections 1 or extension sections can be fitted to both ends of the main sections 1. Operation tables of this kind are known and the present invention is concerned with the means for fixing and locking the extension section 4, or each of them, to the main sections 1. For convenience of description, the table will hereinafter be described with one extension section 4 arranged to be fitted to one end of the main sections.

In the arrangement illustrated, a pair of extension support sockets 5 are secured to the main sections 1 near one end. These sockets 5 are disposed at each side of the main sections 1 and form female support members adapted to receive complementary supporting arms or male members 6 of the extension section 4. Each socket 5 is open at the end of the main sections 1. Conveniently, but not essentially, the sockets 5 are U-shaped channel members arranged with the web of the channel in the vertical position. Each socket 5 is wider at its open end.

A locking strip 7 of spring steel is located in each socket 5. This locking strip 7 is inclined upwards from the lower face of the socket. The locking strip 7 conveniently has an end located in an inclined slot 8 leading out of the lower face or base of the socket and is secured in that slot by means of a screw 9 which is rotatable in a bore leading from the end of the socket and screwed into engagement with the spring strip 7 to secure it in position.

A cam 10 is rotatable inside the socket on a pivot 11. This cam 10 is rotatable by any suitable means to bear on and further incline the locking strip 7 for a purpose to be described.

The support arms 6 project from the end section 4, and are so positioned that they can enter the sockets as male support members. These projecting support arms 6 are secured to the end of the extension section. They have a portion which is a close, but easy, sliding fit in the sockets 5. They are conveniently of inverted L-section. The leading part of the upright portion of the support arm first entered in the socket is narrower than the main part, the wider portion providing an abutment with the widened end portion of the socket so as to limit movement of the support arm into the socket.

The support arm 6 has a depending locking abutment block 12. The block 12 is of metal which is softer than the strip 7. When the arm 6 is fully entered into the socket 5, the upper edge of the spring locking plate 7 engages the underside of the abutment block 12 and this prevents the arm 6 being withdrawn from the socket 5. To release the arm, it is necessary to rotate the cam 10 to the position indicated in broken lines by raising a plunger 13 further to incline the spring locking strip 7 to disengage the upper edge of the strip 7 from the underside of the abutment block 12. If desired a locking means such as a ball catch may be provided to retain the plunger in the raised position. This permits the supporting arm 6 to be withdrawn.

When the support arm 6 is withdrawn, the abutment block 12 engages the cam 10 to return it to the lower or inoperative position indicated in full lines. This enables the spring locking strip 7 to spring back into a position ready to engage the abutment block 12 the next time the support arm 6 is inserted.

The arm 6 has a peg 14 which will engage a hooked portion 15 on the cam 10 to prevent withdrawal of the arm 6 when the cam is in its lower position indicated in full lines. This provides an additional safety device which will prevent the arm 6 being withdrawn if the spring 7 fails.

What is claimed is:

1. A surgical operation table comprising a platform with a main section and an end extension section which may be removably fitted adjacent an end of the main section, wherein the said extension section has a pair of support arms removably engageable in complementary sockets secured to the main section, at least one of the sockets being provided with a spring locking plate which is engageable with a depending locking abutment portion carried by a support arm inserted in the socket to prevent the arm being withdrawn from the socket, said spring locking plate engaging the underside of said depending locking abutment portion, and means being provided for disengaging the locking plate from the arm when it is desired to remove the extension section from the main section.

2. A surgical operation table as claimed in claim 1 wherein the means for disengaging the locking plate from the arm comprises a cam arranged in the socket and rotatable by the operation of a plunger to bear on the locking plate and move it to a position in which it is disengaged from the arm.

3. A surgical operation table as claimed in claim 2, wherein the locking plate is a strip of spring metal inclined upwardly from a base of the socket.

4. A surgical operation table as claimed in claim 2, wherein the support arm is provided with means engageable with a hooked portion of the cam when the cam is in an inoperative position thereby to prevent the arm being withdrawn from the socket.

* * * * *